US005845422A

United States Patent [19]

Valteau, III

[11] Patent Number: 5,845,422

[45] Date of Patent: Dec. 8, 1998

[54] DECORATIVE ATTACHMENT FOR FOOTWEAR

[76] Inventor: Ferdinand F. Valteau, III, 4977 Lafon Dr., New Orleans, La. 70126

[21] Appl. No.: 813,869

[22] Filed: Mar. 7, 1997

[51] Int. Cl.[6] ..... A43B 23/00

[52] U.S. Cl. ..... 36/136; 36/54; 40/636

[58] Field of Search ..... 36/54, 132, 136, 36/72 R; 24/712.2, 712.3, 712.4, 712.9, 713.2, 713.3, 713.4, 713.6; 224/182; 40/636

[56] References Cited

U.S. PATENT DOCUMENTS

| | | | |
|---|---|---|---|
| 1,381,950 | 6/1921 | Van Deusen | 36/54 |
| 2,454,335 | 11/1948 | Nichols | 36/54 |
| 3,006,086 | 10/1961 | Bird | 36/72 |
| 3,082,553 | 3/1963 | Wilmanns | 36/72 |
| 4,597,198 | 7/1986 | Schweitzer | 36/100 |
| 4,823,426 | 4/1989 | Bragga | 15/210 |
| 4,897,947 | 2/1990 | Kass-Pious | 40/636 |
| 4,958,459 | 9/1990 | Davidson | 36/136 |
| 5,063,690 | 11/1991 | Slenker | 36/136 |
| 5,094,016 | 3/1992 | DiVito | 36/136 |
| 5,209,000 | 5/1993 | Rowland et al. | 36/136 |
| 5,311,679 | 5/1994 | Birch | 36/136 |
| 5,313,719 | 5/1994 | Koethe | 36/72 |
| 5,459,947 | 10/1995 | Lasher | 36/136 |

*Primary Examiner*—M. D. Patterson
*Attorney, Agent, or Firm*—Keaty & Keaty

[57] ABSTRACT

The invention relates a decorative shoe shield suitable for detachable positioning on an article of footwear and for securing thereto by shoelaces. The top surface of the shoe shield is adapted for receiving decorative indicia imprinted thereon. A plurality of openings formed in the body of the shoe shield or in fastener strips securely connected to the flexible body allow securing of the shoe shield to the shoe by shoelaces. The fastener elements can be formed as separate L-shaped or hook-shaped members securely attached to the shield body, or as unitary strips secured along side edges of the body, or formed directly in the body of the decorative attachment.

4 Claims, 2 Drawing Sheets

DECORATIVE ATTACHMENT FOR FOOTWEAR

BACKGROUND OF THE INVENTION

The present invention relates to footwear, and more particularly to a decorative attachment for shoes having laces suitable for detachable securing of the decorative attachment to the instep portion of the footwear.

In recent years, it became popular to display trademarks and logos of manufacturers on various articles of footwear, for example on the sides and rear portions of the shoes. The exterior surface of the shoe is also used for display of numerous emblems and logos often associated with cartoon characters, heros of comic books and the like. Various patents have been issued on the idea of providing a detachable shoe shield for securing on top of the shoe and for defining a decorative surface on which different emblems, characters and other designs can be displayed.

For example, U.S. Pat. No. 5,313,719 issued on May 24, 1984 discloses a shoe shield made with a channel adapted for mounting on the instep of a shoe and for detachable engagement with the shoe with the help of shoelaces. The shoe shield in accordance with '719 patent is provided with a pair of downwardly depending triangularly shaped side legs, a forward tab and one elongated clip. A fastener secured on the bottom surface of the shoe shield allows to detachably secure the shoe shield on the top of the footwear. However, such a design may not be beneficial for some applications, since only the central portion of the shield guard is secured to the shoe, which makes it difficult to keep the shoe shield in a centralized position. Another embodiment disclosed in that patent requires provision of hook and loop fasteners for matching engagement with similar fasteners on the shoe.

The present invention contemplates elimination of drawbacks associated with the prior art and provision of a decorative attachment for footwear that is detachably secured to the top of the footwear with the help of shoelaces provided by the footwear.

SUMMARY OF THE INVENTION

It is, therefore, an object of the present invention to provide a decorative attachment for a footwear that can be detachably secured to the footwear with the help of shoelaces provided with the footwear.

It is another object of the present invention to provide a decorative attachment for a footwear that can be used for imprinting emblems, logos and other indicia selected by the user.

It is a further object of the present invention to provide a decorative attachment for a footwear that covers and protects shoelaces during use.

It is a further object of the present invention to provide a decorative attachment for footwear which is easy to use and inexpensive to manufacture.

These and other objects of the present invention are achieved through a provision of a decorative device for an article of footwear that has an instep portion and shoelaces. The decorative device comprises a flexible body having a discrete width and length suitable for covering at least a part of the instep portion when detachably secured to the shoe.

Some of the embodiments provide for the use of a pair of fastener strips which extend downwardly from opposing side edges of the flexible body and are unitary connected to the flexible body. The fastener strips are provided with a plurality of spaced-apart openings suitable for receiving shoelaces therethrough when the flexible body is secured to the shoe. Another embodiment of the invention provides for a flexible body having a plurality of shoelace-receiving openings formed along opposing side edges of the flexible body in a spaced-apart relationship.

The fastener elements can be made as separate L-shaped or hook-shaped members securely attached to the shield body and extending downwardly therefrom.

The top surface of the flexible body is adapted to receive a decorative indicia thereon. The indicia can represent a logo of a sports team, a cartoon character, a toy or other desirable decorative element.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENTS

Figure 2:
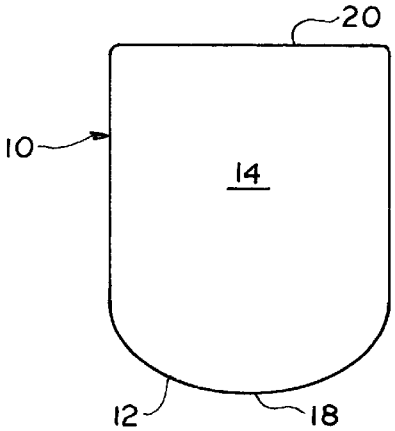
FIG. 2 is top view of the first embodiment of the device of the present invention.

Referring now to the drawings in more detail, numeral 10 designates the first embodiment of the device in accordance with the present invention. The device 10 comprises a flexible shield body 12 having an upper surface 14 and a bottom surface 16. The shield body 12 has a forward edge 18 and a rear edge 20, with the edge 18 being curved, as shown in FIG. 2.

A pair of downwardly depending fasteners 22 and 24 are fixedly secured, or unitary connected to the body 12 and extend downwardly from the sides 26 and 28 of the shield body 12, respectively.

Figure 1:
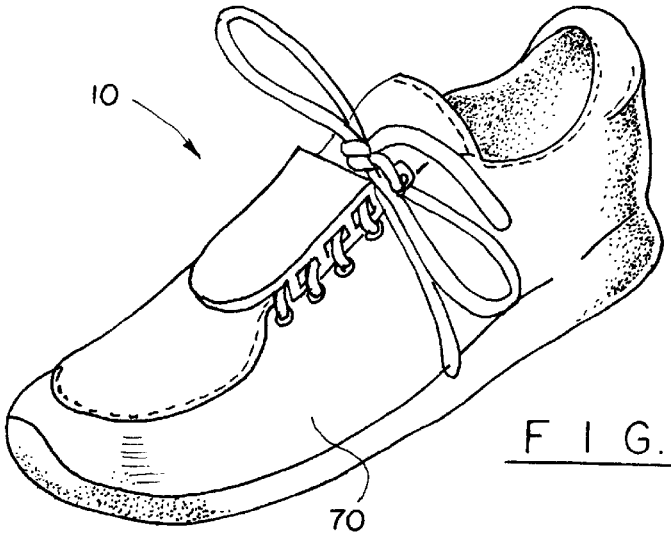
FIG. 1 is perspective view of the device of the present invention mounted on an instep portion of a shoe.
Figure 3:
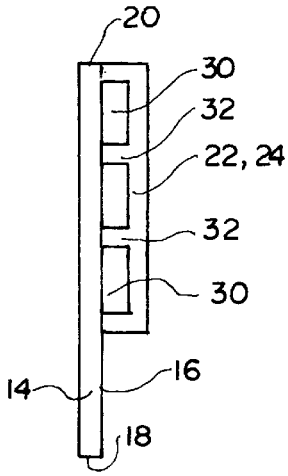
FIG. 3 is a side view of the first embodiment of the present invention.
Figure 4:
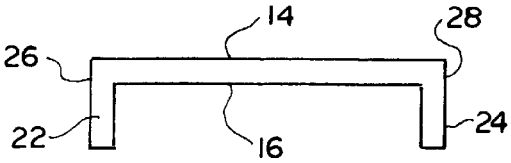
FIG. 4 is an end view of the first embodiment of the device of the present invention.

FIG. 3 illustrates a side view of the decorative device of the first embodiment showing the fastener elements provided with a plurality of openings 30 spaced apart from each other and divided by dividing strips 32. The number of openings 30 depends on the size of the shield body 12 and can be two or more in number. The space between the openings 30 generally corresponds to the space between corresponding openings for shoelaces formed in a shoe, for example an athletic shoe 70, as shown in FIG. 1.

The part of the shield body 12, defined by the curved edge 18 does not have the fastener element 22 or 24 extending along it. It is envisioned, that this part of the shield body will also remain securely positioned, along with the remainder of the body 12, once the shoelaces are extended through the openings 30.

The top surface 14 of the shield body 12 presents a surface suitable for convenient application of various indicia, such as emblems, logos, cartoon characters and the like. It is also envisioned that logos of various sport teams can be imprinted, embroidered, stamped, or otherwise incorporated into the decorative attachment 10, making the device 10 attractive to sport team fans.

The shield body 12, as well as the fastener elements 22, 24 are made from a flexible material which can easily bend to correspond to the natural curve of the top instep surface of a shoe.

Figure 5:
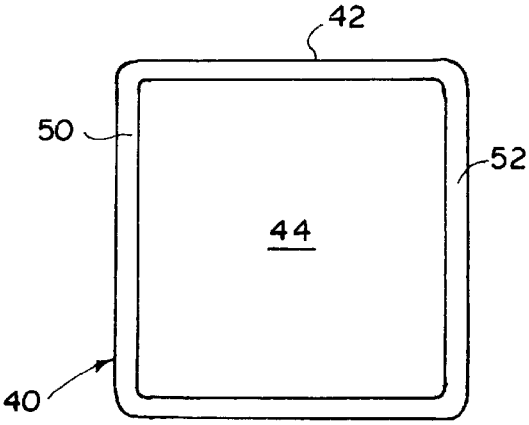
FIG. 5 is a top view of the second embodiment of the device in accordance with the present invention.
Figure 6:
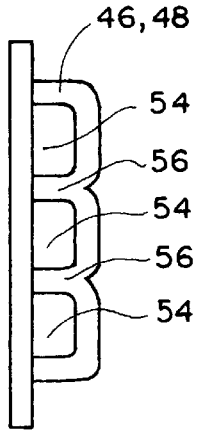
FIG. 6 is a side view of the embodiment shown in FIG. 5.
Figure 7:
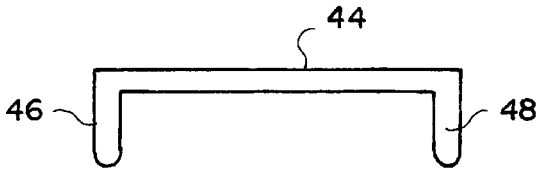
FIG. 7 is an end view of the embodiment shown in FIGS. 5 and 6.

Turning now to the embodiments of FIGS. 5–7, an alternative design for forming the decorative attachment in accordance with the present invention is illustrated. As shown in the drawings, the second embodiment provides for the use of a decorative attachment 40 that comprises of a body portion 42 formed in a square, or rectangular configuration, as desired. The shield body 42 of this embodiment has a top surface 44 adapted for accepting various indicia, such as emblems, logos, cartoon characters, and the like. The indicia can be embroidered, stamped,engraved or otherwise imprinted on the surface 44, similar to the first embodiment of this invention.

A pair of fastener strips 46 and 48 are securely attached to the sides 50 and 52 of the shield body 42, respectively. Each fastener element 46 and 48 is provided with a plurality of openings 54 spaced along the body of the fastener elements 46, 48 and divided by separating strips 56.

In this embodiment, the securing strips 46 and 48 extend through substantially the entire length of the shield body 42, as shown in FIG. 6. The fastener elements 46 and 48 as well as fastener elements 22, 24, are relatively narrow, so as to limit the distance to which the shield bodies 42 and 12, extend above the top surface of a shoe.

The openings 30 and 54 are large enough to allow a shoelace to pass therethrough without any effort, similar to the openings normally found in conventional footwear. The shield body 42, similar to the shield body 12 is manufactured from a soft, flexible material which can readily bend to accommodate the shape of the instep of a shoe.

Figure 8:
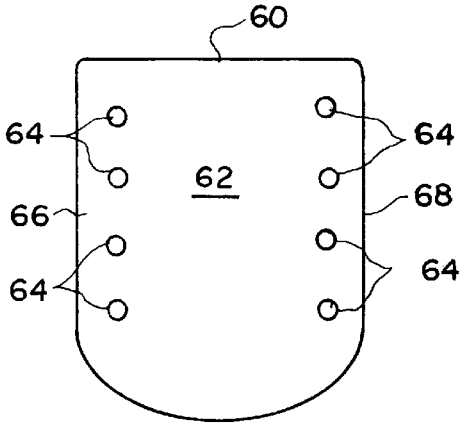
FIG. 8 is the third embodiment of the device in accordance with the present invention.

As shown in FIG. 8, the decorative device of the present invention can be manufactured as a single piece comprising a body 60 having a top surface 62 suitable for receiving decorative indicia thereon. In this embodiment, the shoelace receiving openings 64 are formed directly in the body portion 60 and extend in a spaced-apart relationship along the sides 66 and 68 of the body 60.

In this embodiment, the shoelaces pass through the openings 64, forcing the sides 66 and 68 to curve downwardly, to some degree, and causing the sides 66 and 68 to conform substantially to the curved surface of the instep of the shoe. As with embodiments shown in FIGS. 1–7, the number of openings 64 varies depending on the size of the device body 60 and can extend through a part of the instep portion or through substantially entire instep portion of a shoe.

The body 60, similarly to the bodies 12 and 42 is formed from a flexible material which can easily bend when laces are extended through the openings 64. This material can be fabric, leather, synthetic material, or any other suitable material selected by a manufacturer.

Figure 9:
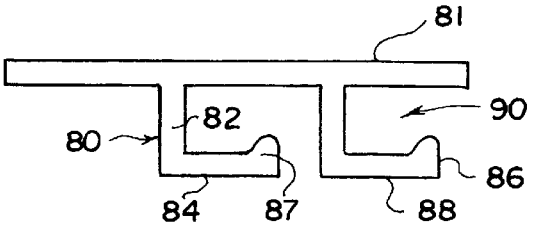
FIG. 9 is a side view of the fourth embodiment of the device of the present invention.

FIG. 9 illustrates still another embodiment of the device of the present invention, wherein shoelace-engaging fastener strips, or elements 80 are L-shaped. Each fastener element 80 has a downwardly extending member 82 and a longitudinally extending member 84, which is unitary connected to the element 82 at a right angle. The fastener element 80 is secured to a shoe shield 81, as shown in FIG. 9.

A stop 86 is formed on a free end 88 of the member 84 to prevent a shoelace from sliding out of a channel 90 defined by the members 82 and 84. The stop 86 can have a rounded upper surface 87, as shown in FIG. 9, or it can have any other desired configuration.

Figure 10:
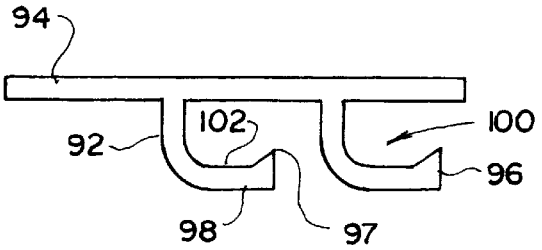
FIG. 10 is a side view of the fifth embodiment of the device of the present invention.

A similar approach to a fastener element is illustrated in FIG. 10. A fastener element 92 of this embodiment is comprised of an arcuate hook-shaped member securely attached to a flat shoe shield 94 in a unitary manner. A stop 96 is formed on a free end 98 of each of the elements 92 to prevent disengagement of a shoelace therefrom. The stop 96 can have an elevated tip 97, as shown in FIG. 10, that can be of a triangular, oval or other desired cross-section. A shoelace, when engaged in a channel 100, will rest on an upper surface 102 of the member 92.

The shoe shield bodies 81 and 94 can be made similar to the shield bodies 10 and 40 of the first and second embodiments of this invention. The number of the fastener elements 80 and 92 can very depending on the size of the shield bodies 81 and 94, respectively.

Figure 11:
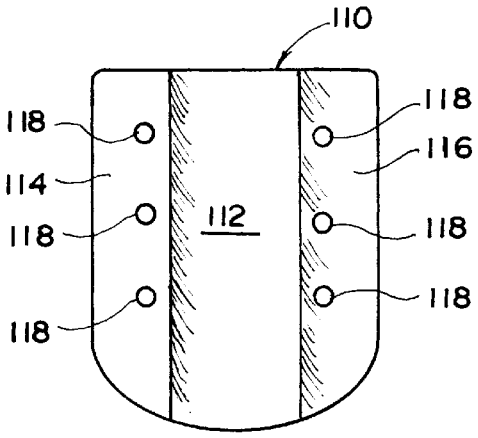
FIG. 11 is a top view of the sixth embodiment of the device of the present invention.
Figure 12:
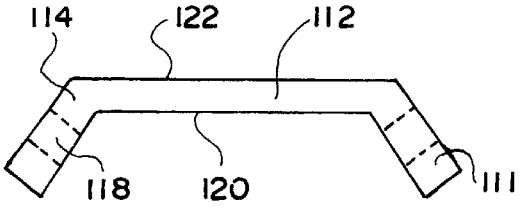
FIG. 12 is an end view of the embodiment shown in FIG. 11.

FIGS. 11 and 12 illustrate still further embodiment of the shoe shield device in accordance with the present invention. As can be seen in FIG. 12, the shied device 110 comprises a unitary body having a central portion 112 and a pair of angularly downwardly inclined side portions 114 and 116. The portions 114 and 116 can be connected to the central portion 112 unitary or by stitching, if desired.

A plurality of openings 118 are formed along the side portions 114 and 116, to allow passing of shoelaces therethrough.

In operation, the shield device 110 is placed on top of an instep portion of a shoe 70, with the bottom portion 120 of the central portion 112 resting above the shoelaces. The side portions 114 and 116 extend on both sides of the instep portion of the shoe, allowing shoelaces to pass therethrough and to secure the device 110 to the shoe 70. An upper surface 122 of the central portion 112 receives a decorative design, if desired, similar to the embodiments of FIGS. 1–10.

In addition to presenting a decorative attachment for an article of footwear, the device of the present invention protects the top of the shoe, particularly in the area of laced openings, shielding the shoes from debris that might accumulate on the laces in time. In this respect, the decorative attachment in accordance with the present invention serves a utilitarian purpose, as well.

In use, the shield devices 10, 40, 60, 81 or 94 are positioned over the shoelaces, in any location along the instep of the shoe. Since the size of the shield bodies 12, 42, 60, 81 and 94 is arbitrary, the shield bodies can extend along substantially the entire instep portion or be limited only to a portion thereof. The laces are extended through the openings 30, 54, 64, or within channels 90, 100, while the devices 10, 40, 60, 81 and 94 are centered in a covering relationship over the instep portion of the footwear.

Many other changes and modifications can be made in the design of the present invention without departing from the spirit thereof. I, therefore, pray that my rights to the present invention be limited only by the scope of the appended claims.

I claim:

1. A decorative device for an article of footwear having an instep portion with shoelaces, the device comprising:

a flexible body suitable for covering at least a part of the instep portion; and a plurality of hook-shaped fastener elements extending downwardly from opposing sides of the body, said fastener elements being securely attached to the body in a spaced-apart relationship, each of said fastener elements defining a channel for receiving a shoelace therein to thereby secure the body on said article of footwear, each of said fastener elements being provided with means for preventing disengagement of a shoelace from said channel, said disengagement preventing means comprising an upwardly turned free end of each of said fastener element.

2. The device of claim 1, wherein each of said fastener elements has a generally L-shaped configuration.

3. The device of claim 1, wherein each of said fastener elements has generally hook-shaped configuration.

4. The device of claim 1, wherein each of said fastener elements is provided with means for preventing disengagement of a shoelace from said channel.

* * * * *